US012655511B2

(12) United States Patent
Ito et al.

(10) Patent No.: US 12,655,511 B2
(45) **Date of Patent: *Jun. 16, 2026**

(54) STEEL SHEET AND PRESS-FORMED ARTICLE

(71) Applicant: NIPPON STEEL CORPORATION, Tokyo (JP)

(72) Inventors: Yasuhiro Ito, Tokyo (JP); Hiroyuki Kawata, Tokyo (JP); Mai Nagano, Tokyo (JP); Satoshi Hironaka, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 181 days.

This patent is subject to a terminal disclaimer.

(21) Appl. No.: 18/685,405

(22) PCT Filed: Aug. 27, 2021

(86) PCT No.: PCT/JP2021/031487

§ 371 (c)(1),
(2) Date: Feb. 21, 2024

(87) PCT Pub. No.: WO2023/026465

PCT Pub. Date: Mar. 2, 2023

(65) Prior Publication Data

US 2024/0425960 A1 Dec. 26, 2024

(51) Int. Cl.

| | |
|---|---|
| ***C22C 38/60*** | (2006.01) |
| ***C21D 6/00*** | (2006.01) |
| ***C21D 8/02*** | (2006.01) |
| ***C21D 8/021*** | (2026.01) |
| ***C21D 8/0221*** | (2026.01) |
| ***C21D 8/0247*** | (2026.01) |
| ***C21D 8/0278*** | (2026.01) |
| ***C21D 9/48*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/14*** | (2006.01) |
| ***C22C 38/20*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/32*** | (2006.01) |
| ***C22C 38/38*** | (2006.01) |
| ***C22C 38/44*** | (2006.01) |
| ***C22C 38/50*** | (2006.01) |
| ***C22C 38/54*** | (2006.01) |
| ***C22C 38/58*** | (2006.01) |

(52) U.S. Cl.

CPC ..... *C22C 38/60* (2013.01); *C21D 6/002* (2013.01); *C21D 6/004* (2013.01); *C21D 6/005* (2013.01); *C21D 6/008* (2013.01); *C21D 8/02* (2013.01); *C21D 8/021* (2013.01); *C21D 8/0226* (2013.01); *C21D 8/0236* (2013.01); *C21D 8/0263* (2013.01); *C21D 8/0278* (2013.01); *C21D 9/48* (2013.01); *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/14* (2013.01); *C22C 38/20* (2013.01); *C22C 38/22* (2013.01); *C22C 38/24* (2013.01); *C22C 38/26* (2013.01); *C22C 38/28* (2013.01); *C22C 38/32* (2013.01); *C22C 38/38* (2013.01); *C22C 38/44* (2013.01); *C22C 38/50* (2013.01); *C22C 38/54* (2013.01); *C22C 38/58* (2013.01)

(58) Field of Classification Search

CPC ..... C22C 38/60; C22C 38/001; C22C 38/002; C22C 38/005; C22C 38/008; C22C 38/02; C22C 38/04; C22C 38/06; C22C 38/14; C22C 38/20; C22C 38/22; C22C 38/24; C22C 38/26; C22C 38/28; C22C 38/32; C22C 38/38; C22C 38/44; C22C 38/50; C22C 38/54; C22C 38/58

USPC ..... 428/639

See application file for complete search history.

(56) References Cited

U.S. PATENT DOCUMENTS

| | | | | |
|---|---|---|---|---|
| 2015/0209848 | A1* | 7/2015 | Kopplin | B23K 26/0823 428/659 |
| 2020/0156349 | A1 | 5/2020 | Morishita et al. | |
| 2020/0332379 | A1 | 10/2020 | Friedel et al. | |

FOREIGN PATENT DOCUMENTS

| | | | |
|---|---|---|---|
| CN | 103586353 | A | 2/2014 |
| CN | 106964722 | A | 7/2017 |
| CN | 109715838 | A | 5/2019 |
| EP | 2 116 311 | A1 | 11/2009 |
| JP | 2-30306 | A | 1/1990 |

(Continued)

OTHER PUBLICATIONS

U.S. Notice of Allowance for U.S. Appl. No. 18/579,354, dated Sep. 30, 2025.

(Continued)

*Primary Examiner* — Katherine A Christy

(74) *Attorney, Agent, or Firm* — Birch, Stewart, Kolasch & Birch, LLP

(57) ABSTRACT

The steel sheet contains, as a chemical composition, by mass %, C: 0.040% to 0.100%, Mn: 1.00% to 2.00%, Si: 0.005% to 1.500%, P: 0.100% or less, S: 0.0200% or less, Al: 0.005% to 0.700%, N: 0.0150% or less, O: 0.0100% or less, and a remainder: Fe and impurities, in which an arithmetic mean waviness Wa is in a range of 0.10 to 0.30 μm.

7 Claims, No Drawings

(56) References Cited

FOREIGN PATENT DOCUMENTS

| | | | |
|---|---|---|---|
| JP | 2003-105512 | A | 4/2003 |
| JP | 2005-220430 | A | 8/2005 |
| JP | 2006-70328 | A | 3/2006 |
| JP | 2006-97102 | A | 4/2006 |
| JP | 2009-263685 | A | 11/2009 |
| JP | 2017-2333 | A | 1/2017 |
| WO | WO 98/55246 | A1 | 12/1998 |
| WO | WO 2019/026113 | A1 | 2/2019 |

OTHER PUBLICATIONS

U.S. Office Action for U.S. Appl. No. 18/579,354, dated Apr. 3, 2025.
U.S. Office Action for U.S. Appl. No. 18/579,354, dated Jun. 17, 2025.

* cited by examiner

STEEL SHEET AND PRESS-FORMED ARTICLE

TECHNICAL FIELD OF THE INVENTION

The present invention relates to a steel sheet and a press-formed article.

BACKGROUND ART

From the viewpoint of protecting the global environment, a vehicle body is required to be lighter and have improved collision safety. In order to meet these demands, also with respect to panel system components such as a door outer, high-strengthening and thinning are being studied. Unlike a frame component, these panel system components are required to have high external appearance quality due to public exposure. Therefore, in the related art, even a high-strength steel sheet that has been applied to a frame component is required to have excellent external appearance quality after forming in a case where it is applied to a panel system component.

In order to improve external appearance quality, one object is to suppress the occurrence of ghost lines. The ghost lines are fine irregularities on the order of several millimeters, which occur on a surface because, when a steel sheet having a hard phase and a soft phase is press-formed, a periphery of the soft phase is preferentially deformed. Since the irregularities form stripe patterns on the surface, a press-formed article with the ghost lines is inferior in external appearance quality.

Patent Document 1 discloses a high-strength hot-dip galvanized steel sheet having excellent surface quality. Specifically, Patent Document 1 discloses a high-strength hot-dip galvanized steel sheet that includes a steel sheet (substrate) which contains, by mass %, C: 0.02% to 0.20%, Si: 0.7% or less, Mn: 1.5% to 3.5%, P: 0.10% or less, S: 0.01% or less, Al: 0.1% to 1.0%, N: 0.010% or less, and Cr: 0.03% to 0.5%, and in which a surface oxidation index A during annealing defined by an expression $A=400Al/(4Cr+3Si+6Mn)$ with the contents of Al, Cr, Si, and Mn as the same item is 2.3 or more, a remainder consists of Fe and unavoidable impurities, a structure of the substrate consists of ferrite and a secondary phase, and the secondary phase is predominantly martensite, and that has a hot-dip galvanized layer on a surface of the substrate.

Patent Document 2 discloses a hot-dip galvanized steel sheet which has, in an interface between a hot-dip galvanized layer and the base steel sheet, a Fe—Al alloy layer in which an average thickness is in a range of 0.1 μm to 2.0 μm and a difference between the maximum thickness and the minimum thickness in the steel sheet width direction is within 0.5 μm, and in which, in a refined layer being in direct contact with the Fe—Al alloy layer, the difference between the maximum thickness and the minimum thickness of the refined layer in the steel sheet width direction is within 2.0 μm.

Patent Document 3 discloses a high-strength thin steel sheet in which a Vickers hardness at a position having a depth of 0.05 mm from the front and back surfaces of the steel sheet is in a range of 100 to 250 Hv and is (Vickers hardness at a position having a depth of 0.2 mm from the front and back surfaces)×0.8 or lower, dispersion in Vickers hardness in an inner layer portion on a sheet thickness center side from a position having a depth of 0.2 mm from the front and back surfaces is 100 Hv or less, the inner layer portion contains bainite and martensite of 80% or more in a total area ratio, surface roughness Ra of the steel sheet is in a range of 0.4 to 1.2 μm, and a tensile strength of the steel sheet is 780 MPa or more.

Patent Document 4 discloses a high tensile galvannealed steel sheet in which a hot-dip galvannealed layer has a chemical composition that contains, by mass %, Fe: 10% to 15%, Al: 0.20% to 0.45%, and a remainder consisting of Zn and impurities, and interface adhesion strength between the steel sheet and the hot-dip galvannealed layer is 20 MPa or more.

Patent Document 5 discloses a high-strength steel sheet with less property deterioration after cutting, in which the steel sheet structure is mainly composed of ferrite and bainite, a Mn segregation degree (=central portion Mn peak concentration/average Mn concentration) in a sheet thickness direction is 1.20 or less, and the maximum tensile strength is 540 MPa or more.

PRIOR ART DOCUMENT

Patent Document

[Patent Document 1] Japanese Unexamined Patent Application, First Publication No. 2005-220430
[Patent Document 2] PCT International Publication No. WO2019/026113 [Patent Document 3] Japanese Unexamined Patent Application, First Publication No. 2006-70328
[Patent Document 4] Japanese Unexamined Patent Application, First Publication No. 2006-97102
[Patent Document 5] Japanese Unexamined Patent Application, First Publication No. 2009-263685

DISCLOSURE OF THE INVENTION

Problems to be Solved by the Invention

The present invention has been made in view of the above circumstances. An object of the present invention is to provide a press-formed article having high strength and excellent external appearance quality, and a steel sheet which can manufacture of the press-formed article.

Means for Solving the Problem

The gist of the present invention is as follows.

(1) A steel sheet according to one aspect of the present invention consisting of, as a chemical composition, by mass %:

C: 0.040% to 0.100%,
Mn: 1.00% to 2.00%,
Si: 0.005% to 1.500%,
P: 0.100% or less,
S: 0.0200% or less,
Al: 0.005% to 0.700%,
N: 0.0150% or less,
O: 0.0100% or less,
Cr: 0% to 0.80%,
Mo: 0% to 0.16%,
B: 0% to 0.0100%,
Ti: 0% to 0.100%,
Nb: 0% to 0.060%,
V: 0% to 0.50%,
Ni: 0% to 1.00%,
Cu: 0% to 1.00%,
W: 0% to 1.00%,
Sn: 0% to 1.00%, Sb: 0% to 0.200%,
Ca: 0% to 0.0100%,
Mg: 0%-to 0.0100%,
Zr: 0% to 0.0100%,
REM: 0% to 0.0100%, and
a remainder: Fe and impurities,
in which an arithmetic mean waviness Wa is in a range of 0.10 to 0.30 μm.

(2) The steel sheet according to the above (1) may further include, as the chemical composition, by mass %, one or two or more selected from the group consisting of:
Cr: 0.01% to 0.80%,
Mo: 0.01% to 0.16%,
B: 0.0001% to 0.0100%,
Ti: 0.001% to 0.100%,
Nb: 0.001% to 0.060%,
V: 0.01% to 0.50%,
Ni: 0.01% to 1.00%,
Cu: 0.01% to 1.00%,
W: 0.01% to 1.00%,
Sn: 0.01% to 1.00%,
Sb: 0.001% to 0.200%,
Ca: 0.0001% to 0.0100%,
Mg: 0.0001% to 0.0100%,
Zr: 0.0001% to 0.0100%, and
REM: 0.0001% to 0.0100%.

(3) In the steel sheet according to the above (1) or (2), when an average value of Mn concentration in a region from a position separated by ⅛ of a sheet thickness in a sheet thickness direction from a surface of the steel sheet to a position separated by ⅜ of the sheet thickness in the sheet thickness direction from the surface is set to be μ and a standard deviation of the Mn concentration is set to be σ, $(3\sigma/\mu)\times100\leq7.0$ may be satisfied.

(4) In the steel sheet according to any one of the above (1) to (3), a surface of the steel sheet may have a decarburized layer having a thickness of 20 μm or more.

(5) In the steel sheet according to any one of the above (1) to (4), at least one surface of the steel sheet may have a plating layer.

(6) A press-formed article according to another aspect of the present invention is obtained by press-forming the steel sheet according to any one of the above (1) to (5).

Effects of the Invention

According to the above aspects of the present invention, it is possible to provide a press-formed article having high strength and excellent external appearance quality, and a steel sheet which can manufacture of the press-formed article.

EMBODIMENTS OF THE INVENTION

The inventors of the present invention have studied a method for suppressing the occurrence of ghost lines after press forming of a high-strength steel sheet. As a result, the inventors of the present invention have found that it is effective to reduce a hardness difference in steel and control the surface roughness of the steel sheet within a desired range. One of the factors that causes the hardness difference in steel is band-shaped Mn segregation that occurs during a solidification process of the steel. When Mn segregation occurs in a band shape, since a periphery of a location where Mn concentration is high is easily transformed to austenite during annealing, hard martensite occurs in a band shape after annealing is performed after cold rolling. As a result, the hardness difference in steel increases, and it is considered that ghost lines occur during press forming.

In general, the smaller the surface roughness of a steel sheet that is used as a material, the more preferable it is. This is because, in a case where the surface roughness of the steel sheet is excessively large, external appearance quality is inferior. However, the inventors of the present invention have found that in order to suppress the occurrence of ghost lines in a press-formed article, it is important to moderately roughen the surface of the steel sheet as a material to the extent that external appearance quality does not deteriorate.

The present invention has been made based on the above knowledge, and a steel sheet and a press-formed article according to the present embodiment will be described in detail below. However, the present invention is not limited to configurations disclosed in the present embodiment, and various modifications can be made without departing from the gist of the present invention.

First, a chemical composition of the steel sheet according to the present embodiment will be described. The numerical limit range described below with "to" in between includes the lower limit and the upper limit. Numerical values indicated as "less than" or "exceed" do not fall within the numerical range. In the following description, % regarding the chemical composition is mass % unless otherwise specified.

A steel sheet according to an aspect of the present embodiment contains, as a chemical composition, by mass %, C: 0.040% to 0.100%, Mn: 1.00% to 2.00%, Si: 0.005% to 1.500%, P: 0.100% or less, S: 0.0200% or less, Al: 0.005% to 0.700%, N: 0.0150% or less, O: 0.0100% or less, and a remainder: Fe and impurities. Each element will be described below.

C: 0.040% to 0.100%

C is an element that increases the strength of the steel sheet and a press-formed article. In order to obtain a desired strength, the C content is set to 0.040% or more. In order to further increase the strength, the C content is preferably 0.050% or more, and more preferably 0.060% or more, 0.070% or more, or 0.075% or more.

Further, by setting the C content to 0.100% or less, the diffusion of Mn during solidification is facilitated, and in this way, easy occurrence of band-shaped Mn segregation can be suppressed. As a result, the occurrence of ghost lines after press forming can be suppressed. Therefore, the C content is set to 0.100% or less. The C content is preferably 0.095% or less, and more preferably 0.090% or less or 0.085% or less.

In a case where Mn content is 1.40% or less, it is preferable that the C content exceeds 0.075%. By strictly controlling the Mn content and the C content in this manner, Mn diffusion in steel is promoted at a high temperature, and Mn segregation can be reduced.

Mn: 1.00% to 2.00%

Mn is an element that enhances the hardenability of steel and contributes to improvement in strength. In order to obtain a desired strength, the Mn content is set to 1.00% or more. The Mn content is preferably 1.05% or more, 1.10% or more, or 1.20% or more, and more preferably 1.30% or more, 1.40% or more, or 1.50% or more.

Further, when the Mn content is 2.00% or less, the occurrence of band-shaped Mn segregation can be suppressed during solidification of steel. Therefore, the Mn content is set to 2.00% or less. The Mn content is preferably 1.85% or less, more preferably 1.80% or less, and even more preferably 1.75% or less.

Si: 0.005% to 1.500%

Si is an element that improves the strength-formability balance of the steel sheet. In order to obtain this effect, the Si content is set to 0.005% or more. Preferably, the Si content is 0.010% or more.

Further, Si is also an element that forms a coarse Si oxide that acts as a starting point for destruction. By setting the Si content to 1.500% or less, the formation of a Si oxide can be suppressed, and cracking does not easily occur. As a result, embrittlement of steel can be suppressed. Therefore, the Si content is set to 1.500% or less. The Si content is preferably 1.300% or less and more preferably 1.000% or less.

P: 0.100% or less

P is an impurity element and is an element that makes steel brittle. When the P content is 0.100% or less, the steel sheet can be suppressed from becoming brittle and being easily cracked during a production process. Therefore, the P content is set to 0.100% or less. From the viewpoint of productivity, the P content is preferably 0.050% or less, and more preferably 0.030% or less or 0.020% or less. Although a lower limit of the P content includes 0%, a manufacturing cost can be further reduced by setting the P content to 0.001% or more. Therefore, the P content may be set to 0.001% or more.

S: 0.0200% or less

S is an impurity element and is an element that forms a Mn sulfide and deteriorates formability such as ductility, hole expansibility, stretch flangeability, and bendability of the steel sheet. When the S content is 0.0200% or less, a significant decrease in formability of the steel sheet can be suppressed. Therefore, the S content is set to 0.0200% or less. The S content is preferably 0.0100% or less and more preferably 0.0080% or less.

Although a lower limit of the S content includes 0%, a manufacturing cost can be further reduced by setting the S content to 0.0001% or more. Therefore, the S content may be set to 0.0001% or more.

Al: 0.005% to 0.700%

Al is an element that functions as a deoxidizing material. In order to sufficiently obtain a deoxidizing effect of Al, the Al content is set to 0.005% or more. The Al content is preferably 0.010% or more or 0.025% or more.

Further, Al is also an element that forms a coarse oxide that serves as a starting point for destruction and that makes steel brittle. By setting the Al content to 0.700% or less, it is possible to suppress the formation of a coarse oxide that acts as a starting point for destruction, and to suppress a cast piece from being easily cracked. Therefore, the Al content is set to 0.700% or less. An upper limit of the Al content is preferably 0.600%, 0.400%, 0.200%, or 0.100%, and more preferably 0.085%, 0.070%, 0.065%, or 0.060%.

N: 0.0150% or less

N is an impurity element and is an element that forms a nitride and deteriorates the formability such as ductility, hole expansibility, stretch flangeability, and bendability of the steel sheet. When the N content is 0.0150% or less, a decrease in formability of the steel sheet can be suppressed. Therefore, the N content is set to 0.0150% or less. Further, N is also an element that causes weld defects during welding and hinders productivity. Therefore, the N content is preferably 0.0120% or less and more preferably 0.0100% or less.

Although a lower limit of the N content includes 0%, a manufacturing cost can be further reduced by setting the N content to 0.0005% or more. Therefore, the N content may be set to 0.0005% or more.

O: 0.0100% or less

O is an impurity element and is an element that forms an oxide and hinders the formability such as ductility, hole expansibility, stretch flangeability, and bendability of the steel sheet. When the O content is 0.0100% or less, a significant decrease in formability of the steel sheet can be suppressed. Therefore, the O content is set to 0.0100% or less. The O content is preferably 0.0080% or less and more preferably 0.0050% or less.

Although a lower limit of the O content includes 0%, a manufacturing cost can be further reduced by setting the O content to 0.0001% or more. Therefore, the O content may be set to 0.0001% or more.

The steel sheet according to the present embodiment may contain the following elements as optional elements, instead of a part of Fe. The contents of the following optional elements are 0% in a case where the following optional elements are not contained.

Cr: 0% to 0.80%

Cr is an element that increases the hardenability of steel and contributes to improvement in strength of the steel sheet. Since Cr does not need to be contained, a lower limit of the Cr content includes 0%. In order to sufficiently obtain a strength improvement effect of Cr, the Cr content is preferably 0.01% or more, more preferably 0.20% or more, and even more preferably 0.30% or more.

Further, when the Cr content is 0.80% or less, the formation of a coarse Cr carbide that may act as a starting point for destruction can be suppressed. Therefore, the Cr content is set to 0.80% or less. In order to reduce alloy costs, an upper limit of the Cr content may be set to 0.60%, 0.40%, 0.20%, 0.10%, or 0.05%, as necessary.

Mo: 0% to 0.16%

Mo is an element that suppresses phase transformation at a high temperature and contributes to improvement in strength of the steel sheet. Since Mo does not need to be contained, a lower limit of the Mo content includes 0%. In order to sufficiently obtain a strength improvement effect of Mo, the Mo content is preferably 0.01% or more, more preferably 0.05% or more, and even more preferably 0.10% or more.

Further, when the Mo content is 0.16% or less, a decrease in hot workability and a decrease in productivity can be suppressed. Therefore, the Mo content is set to 0.16% or less. In order to reduce alloy costs, an upper limit of the Mo content may be set to 0.12%, 0.10%, 0.08%, or 0.04%, as necessary.

By containing both Cr: 0.01% to 0.80% and Mo: 0.01% to 0.16%, it is possible to more reliably improve the strength of the steel sheet, which is preferable.

B: 0% to 0.0100%

B is an element that suppresses phase transformation at a high temperature and contributes to improvement in strength of the steel sheet. Since B does not need to be contained, a lower limit of the B content includes 0%. In order to sufficiently obtain a strength improvement effect of B, the B content is preferably 0.0001% or more, more preferably 0.0005% or more, and even more preferably 0.0010% or more.

Further, when the B content is 0.0100% or less, a decrease in strength of the steel sheet due to creation of B precipitates can be suppressed. Therefore, the B content is set to 0.0100% or less. In order to reduce alloy costs, an upper limit of the B content may be set to 0.0050%, 0.0030%, 0.0020%, 0.0010%, or 0.0005%, as necessary.

Ti: 0% to 0.100%

Ti is an element that has the effect of reducing the amounts of S, N, and O that generate coarse inclusions that act as starting points for destruction. Further, Ti has the effect of refining the structure and improving the strength-formability balance of the steel sheet. Since Ti does not need to be contained, a lower limit of the Ti content includes 0%. In order to sufficiently obtain the above effects, the Ti content is set to preferably 0.001% or more, and more preferably 0.001% or more.

Further, when the Ti content is 0.100% or less, the formation of coarse Ti sulfides, Ti nitrides, and Ti oxides can be suppressed, and the formability of the steel sheet can be secured. Therefore, the Ti content is set to 0.100% or less. The Ti content is set to preferably 0.080% or less, and more preferably 0.060% or less. In order to reduce alloy costs, an upper limit of the Ti content may be set to 0.040%, 0.020%, 0.010%, or 0.005%, as necessary.

Nb: 0% to 0.060%

Nb is an element that contributes to improvement in strength of the steel sheet through strengthening by precipitates, grain refinement strengthening by growth suppression of ferrite grains, and dislocation strengthening by suppression of recrystallization. Since Nb does not need to be contained, a lower limit of the Nb content includes 0%. In order to sufficiently obtain the above effect, the Nb content is preferably 0.001% or more, more preferably 0.005% or more, and even more preferably 0.010% or more.

Further, when the Nb content is 0.060% or less, recrystallization can be promoted, remaining of non-recrystallized ferrite can be suppressed, and the formability of the steel sheet can be secured. Therefore, the Nb content is set to 0.060% or less. The Nb content is preferably 0.050% or less and more preferably 0.040% or less. In order to reduce alloy costs, an upper limit of the Nb content may be set to 0.030%, 0.020%, 0.010%, or 0.005%, as necessary.

V: 0% to 0.50%

V is an element that contributes to improvement in strength of the steel sheet through strengthening by precipitates, grain refinement strengthening by growth suppression of ferrite grains, and dislocation strengthening by suppression of recrystallization. Since V does not need to be contained, a lower limit of the V content includes 0%. In order to sufficiently obtain a strength improvement effect of V, the V content is preferably 0.01% or more, and more preferably 0.03% or more.

Further, when the V content is 0.50% or less, a decrease in formability of the steel sheet due to precipitation of a large amount of carbonitrides can be suppressed. Therefore, the V content is set to 0.50% or less. In order to reduce alloy costs, an upper limit of the V content may be set to 0.30%, 0.20%, 0.10%, 0.05%, or 0.02%, as necessary.

Ni: 0% to 1.00%

Ni is an element that suppresses phase transformation at a high temperature and contributes to improvement in strength of the steel sheet. Since Ni does not need to be contained, a lower limit of the Ni content includes 0%. In order to sufficiently obtain a strength improvement effect of Ni, the Ni content is preferably 0.01% or more, more preferably 0.05% or more, and even more preferably 0.20% or more.

Further, when the Ni content is 1.00% or less, a decrease in the weldability of the steel sheet can be suppressed. Therefore, the Ni content is set to 1.00% or less. In order to reduce alloy costs, an upper limit of the Ni content may be set to 0.60%, 0.40%, 0.20%, 0.10%, or 0.03%, as necessary.

Cu: 0% to 1.00%

Cu is an element that exists in steel in the form of fine particle and contributes to improvement in strength of the steel sheet. Sine Cu does not need to be contained, a lower limit of the Cu content includes 0%. In order to sufficiently obtain a strength improvement effect of Cu, the Cu content is preferably 0.01% or more, more preferably 0.05% or more, and even more preferably 0.15% or more.

Further, when the Cu content is 1.00% or less, a decrease in the weldability of the steel sheet can be suppressed. Therefore, the Cu content is set to 1.00% or less. In order to reduce alloy costs, an upper limit of the Cu content may be set to 0.60%, 0.40%, 0.20%, 0.10%, or 0.03%, as necessary.

W: 0% to 1.00%

W is an element that suppresses phase transformation at a high temperature and contributes to improvement in strength of the steel sheet. Since W does not need to be contained, a lower limit of the W content includes 0%. In order to sufficiently obtain a strength improvement effect of W, the W content is preferably 0.01% or more, more preferably 0.03% or more, and even more preferably 0.10% or more.

Further, when the W content is 1.00% or less, a decrease in hot workability and a decrease in productivity can be suppressed. Therefore, the W content is set to 1.00% or less. In order to reduce alloy costs, an upper limit of the W content may be set to 0.50%, 0.20%, 0.10%, 0.05%, or 0.02%, as necessary.

Sn: 0% to 1.00%

Sn is an element that suppresses coarsening of crystal grains and contributes to improvement in strength of the steel sheet. Since Sn does not need to be contained, a lower limit of the Sn content includes 0%. In order to sufficiently obtain an effect of Sn, the Sn content is more preferably 0.01% or more.

Further, when the Sn content is 1.00% or less, embrittlement of the steel sheet and breakage during rolling can be suppressed. Therefore, the Sn content is set to 1.00% or less. In order to reduce alloy costs, an upper limit of the Sn content may be set to 0.50%, 0.20%, 0.10%, 0.05%, or 0.02%, as necessary.

Sb: 0% to 0.200%

Sb is an element that suppresses coarsening of crystal grains and contributes to improvement in strength of the steel sheet. Since Sb does not need to be contained, a lower limit of the Sb content includes 0%. In order to sufficiently obtain the above effect, the Sb content is preferably 0.001% or more, and more preferably 0.005% or more.

Further, when the Sb content is 0.200% or less, embrittlement of the steel sheet and breakage during rolling can be suppressed. Therefore, the Sb content is set to 0.200% or less. In order to reduce alloy costs, an upper limit of the Sb content may be set to 0.100%, 0.070%, 0.040%, 0.010%, or 0.005%, as necessary.

Ca: 0% to 0.0100%

Mg: 0% to 0.0100%

Zr: 0% to 0.0100%

REM: 0% to 0.0100%

Ca, Mg, Zr, and REM are elements that contribute to improvement in formability of the steel sheet. Since Ca, Mg, Zr, and REM do not need to be contained, a lower limit of the total content of these elements includes 0%. In order to sufficiently obtain the effect of improving formability, the content of each of these elements is preferably 0.0001% or more, and more preferably 0.0010% or more. In order to sufficiently obtain the above effect, it is not necessary to contain all of the above elements, and the content of any one of the above elements may be 0.0001% or more.

Further, when the content of each of Ca, Mg, Zr, and REM is 0.0100% or less, a decrease in ductility of the steel sheet can be suppressed. Therefore, the content of each of these elements is set to 0.0100% or less. Preferably, the content of each of these elements is 0.0050% or less. In order to reduce alloy costs, an upper limit of the content of each of Ca, Mg, Zr, and REM may be set to 0.0030%, 0.0020%, 0.0010%, or 0.0003%, as necessary.

Rare Earth Metal (REM) refers to a total of 17 elements consisting of Sc, Y, and lanthanides, and the REM content refers to the total content of these elements.

The remainder of the chemical composition of the steel sheet according to the present embodiment may be Fe and impurities. As the impurities, impurities that are unavoidably mixed in from a steel raw material or scraps and/or during a steelmaking process, or elements that are allowed within a range that does not impair the properties of the steel sheet according to the present embodiment are exemplary examples. As examples of the impurities, H, Na, Cl, Co, Zn, Ga, Ge, As, Se, Y, Tc, Ru, Rh, Pd, Ag, Cd, In, Te, Cs, Ta, Re, Os, Ir, Pt, Au, Pb, Bi, and Po can be given. The total content of the impurities may be 0.100% or less.

The chemical composition of the steel sheet described above may be measured by a general analysis method. For example, the chemical composition may be measured using Inductively Coupled Plasma-Atomic Emission Spectrometry (ICP-AES). C and S may be measured using a combustion-infrared absorption method, N may be measured using an inert gas fusion-thermal conductivity method, and O may be measured using an inert gas fusion-nondispersive infrared absorption method.

In a case where the steel sheet has a plating layer on the surface thereof, the chemical composition may be analyzed after the plating layer on the surface is removed by mechanical grinding.

Arithmetic mean waviness Wa: 0.10 to 0.30 μm

In general, the smaller the arithmetic mean waviness Wa of the steel sheet that is a material, the more preferable it is from the viewpoint of external appearance quality. However, the inventors of the present invention have found that in order to suppress the occurrence of ghost lines in a press-formed article, the occurrence of ghost lines in the press-formed article can be suppressed by moderately roughening the surface of the steel sheet that is a material, specifically, by setting the arithmetic mean waviness Wa to 0.10 μm or more. Therefore, in the steel sheet according to the present embodiment, the arithmetic mean waviness Wa is set to 0.10 μm or more. Preferably, the arithmetic mean waviness Wa is set to 0.13 μm or more.

Further, in a case where the arithmetic mean waviness Wa is excessively large, the external appearance quality of the steel sheet itself deteriorates, and low external appearance quality is maintained even after press forming. Therefore, the arithmetic mean waviness Wa is set to 0.30 μm or less. Preferably, the arithmetic mean waviness Wa is set to 0.25 μm or less.

The arithmetic mean waviness Wa is an arithmetic mean waviness of the steel sheet in a case where the steel sheet does not have a plating layer, and is an arithmetic mean waviness of a plating layer in a case where the steel sheet has a plating layer on the surface thereof.

In the present embodiment, the arithmetic mean waviness Wa is obtained by the following method.

A test piece having a size of 50 mm×50 mm is cut out from a position 10 mm or more away from an end surface of the steel sheet. Next, three lines of a profile are measured along a direction orthogonal to a rolling direction by using a laser displacement measuring device (Keyence VK-X1000). From the obtained results, waviness curves are obtained by sequentially applying contour curve filters having cutoff values λc and λf to a profile curve in accordance with JIS B 0601:2013. Specifically, waviness curves are obtained by removing a component having a wavelength λc of 0.8 mm or less and a component having a wavelength λf of 2.5 mm or more from the obtained measurement results. An arithmetic mean waviness is calculated in accordance with JIS B 0601:2013, based on the obtained waviness curves, and an average value of a total of three lines is calculated. The arithmetic mean of the calculated average values of the three lines is taken as the arithmetic mean waviness Wa of the steel sheet.

In a case where the steel sheet has a plating layer on the surface thereof, the surface of the plating layer may be subjected to the line analysis described above.

$$(3\sigma/\mu)\times 100 \leq 7.0$$

In the steel sheet according to the present embodiment, when an average value of Mn concentration in a region from a position separated by ⅛ of a sheet thickness in a sheet thickness direction from a surface of the steel sheet to a position separated by ⅜ of the sheet thickness in the sheet thickness direction from the surface (a region from ⅛ depth from the surface of the steel sheet to ⅜ depth from the surface of the steel sheet) is set to be μ in unit mass %, and a standard deviation of the Mn concentration is set to be σ in unit mass %, it is preferable that $(3\sigma/\mu)\times 100\leq 7.0$ is satisfied. By setting $(3\sigma/\mu)\times 100$ to 7.0 or less, the occurrence of Mn segregation in the steel sheet can be further reduced, the occurrence of ghost lines can be further suppressed, and a press-formed article having more excellent external appearance quality can be obtained. It is more preferable that $(3\sigma/\mu)\times 100$ is set to 6.5 or less. Although a lower limit of $(3\sigma/\mu)\times 100$ is not particularly limited, it may be set to 0. Since the manufacturing cost increases in order to make $(3\sigma/\mu)\times 100$ low, the lower limit may be set to 2.0, 4.0, or 5.0. An upper limit of $(3\sigma/\mu)\times 100$ may be set to 11.0, 10.0, 9.0, or 8.0, as necessary.

In the present embodiment, the average value μ of the Mn concentration and the standard deviation σ of the Mn concentration are obtained by the following method.

After a sheet thickness cross section of the steel sheet is mirror-polished, the Mn concentration is measured at 600 points at a measurement interval of 1 μm in a rolling direction of the steel sheet at a predetermined depth position. The Mn concentration (mass %) at a predetermined depth position is obtained by calculating an average value of the obtained Mn concentration. This operation is performed every 1 μm in the sheet thickness direction from a position separated by ⅛ of the sheet thickness in the sheet thickness direction from the surface of the steel sheet to a position separated by ⅜ of the sheet thickness in the sheet thickness direction from the surface. The average value μ of the Mn concentration is obtained by calculating an average value (arithmetic mean) of all the obtained Mn concentrations. Further, the standard deviation σ of the Mn concentration is obtained by calculating a standard deviation from all the obtained Mn concentrations.

A device that is used is an electron probe microanalyzer (EPMA), and a measurement condition is an acceleration voltage of 15 kV.

The steel sheet according to the present embodiment may have a plating layer on at least one surface of the steel sheet. As the plating layer, a galvanized layer, a zinc alloy plating layer, and an alloyed galvanized layer and an alloyed zinc alloy plating layer obtained by performing alloying treatment on the above layers can be given.

The galvanized layer and the zinc alloy plating layer are formed by a hot-dip plating method, an electroplating method, or a vapor deposition plating method. When the Al content of the galvanized layer is 0.5% by mass or less, the adhesion between the surface of the steel sheet and the galvanized layer can be sufficiently secured. Therefore, the Al content of the galvanized layer is preferably 0.5% by mass or less.

In a case where the galvanized layer is a hot-dip galvanized layer, the Fe content of the hot-dip galvanized layer is preferably 3.0% by mass or less in order to increase the adhesion between the steel sheet surface and the galvanized layer.

In a case where the galvanized layer is an electrogalvanized layer, the Fe content of the electrogalvanized layer is preferably 0.5% by mass or less from the viewpoint of improving corrosion resistance.

The galvanized layer and the zinc alloy plating layer may contain one or two or more of Al, Ag, B, Be, Bi, Ca, Cd, Co, Cr, Cs, Cu, Ge, Hf, Zr, I, K, La, Li, Mg, Mn, Mo, Na, Nb, Ni, Pb, Rb, Sb, Si, Sn, Sr, Ta, Ti, V, W, Zr, and REM, in a range that does not impair the corrosion resistance and formability of the steel sheet. In particular, Ni, Al, and Mg are effective in improving the corrosion resistance of the steel sheets.

The galvanized layer or the zinc alloy plating layer may be an alloyed galvanized layer or an alloyed zinc alloy plating layer subjected to alloying treatment. In a case where alloying treatment is performed on the hot-dip galvanized layer or the hot-dip zinc alloy plating layer, from the viewpoint of improving the adhesion between the steel sheet surface and the alloyed plating layer, the Fe content of the hot-dip galvanized layer after the alloying treatment (the alloyed galvanized layer) or the hot-dip zinc alloy plating layer (the alloyed zinc alloy plating layer) is preferably in a range of 7.0 to 13.0% by mass. By performing alloying treatment on the steel sheet having a hot-dip galvanized layer or a hot-dip zinc alloy plating layer, Fe is taken into the plating layer and the Fe content is increased. In this way, it is possible to set the Fe content to 7.0% by mass or more. That is, the galvanized layer having the Fe content of 7.0% by mass or more is an alloyed galvanized layer or an alloyed zinc alloy plating layer.

The Fe content in the plating layer can be obtained by the following method. Only the plating layer is dissolved and removed by using a 5% by volume HCl aqueous solution with an inhibitor added thereto. The Fe content (mass %) in the plating layer is obtained by measuring the Fe content in the obtained solution by using Inductively Coupled Plasma-Atomic Emission Spectrometry (ICP-AES).

The steel sheet according to the present embodiment may have a decarburized layer with a thickness of 20 μm or more on the surface of the steel sheet, regardless of the presence or absence of the plating layer. By setting the thickness of the decarburized layer to 20 μm or more, band-shaped Mn segregation that causes a stripe pattern is reduced, and the external appearance quality after press forming is further improved.

In the present embodiment, the thickness of the decarburized layer is measured by the following method.

C concentration in a region from the surface of the steel sheet to a position separated by ½ of the sheet thickness in the depth direction (sheet thickness direction) is measured every 1 μm depth at three optional locations of the steel sheet. The region having C concentration of ½ or less of the C concentration at the position separated by ½ of the sheet thickness from the surface is regarded as a decarburized layer, and the thickness of the decarburized layer is obtained by determining the thickness of the region.

For the measurement, a Marcus type high-frequency glow discharge luminescence surface analyzer (GD-Profiler) manufactured by Horiba, Ltd. is used.

The sheet thickness of the steel sheet according to the present embodiment is not limited to a specific range, and is preferably in a range of 0.2 to 2.0 mm in consideration of versatility or manufacturability. By setting the sheet thickness to 0.2 mm or more, it becomes easier to keep the steel sheet shape flat, and dimensional accuracy and shape accuracy can be improved. Therefore, the sheet thickness is preferably 0.2 mm or more. More preferably, the sheet thickness is 0.4 mm or more.

On the other hand, when the sheet thickness is 2.0 mm or less, it becomes easier to perform appropriate strain application and temperature control in the manufacturing process, and a homogeneous structure can be obtained. Therefore, the sheet thickness is preferably 2.0 mm or less. More preferably, the sheet thickness is 1.5 mm or less.

It is preferable that the steel sheet according to the present embodiment has a tensile strength in a range of 500 to 750 MPa. By setting the tensile strength to 500 MPa or more, the steel sheet can be suitably applied to the panel system components. By setting the tensile strength to 750 MPa or less, it is possible to improve press formability and to suppress deterioration in external appearance quality due to the occurrence of ghost lines. The tensile strength may have a lower limit of 540 MPa, 580 MPa, or 600 MPa, and an upper limit of 680 MPa or 660 MPa.

The tensile strength is evaluated in accordance with JIS Z 2241:2011. A test piece is a No. 5 test piece of JIS Z 2241:2011. A tensile test piece is taken from a position of a ¼ portion from an end portion in the sheet width direction, and a longitudinal direction thereof is a direction perpendicular to the rolling direction.

Next, the press-formed article according to the present embodiment, which can be manufactured by press-forming the steel sheet described above, will be described. The press-formed article according to the present embodiment has the same chemical composition as that of the steel sheet described above. Further, the press-formed article according to the present embodiment may have the above-described plating layer on at least one surface thereof.

Since the press-formed article according to the present embodiment is obtained by press-forming the steel sheet described above, the occurrence of ghost lines is suppressed and the external appearance quality is excellent. As a specific example of the press-formed article, for example, a panel system component such as a door outer for a vehicle body can be given.

In the press-formed article according to the present embodiment, the external appearance quality being excellent means that striped patterns (that is, ghost lines) occurring on the surface at intervals on the order of several millimeters are not observed. Further, in other words, the maximum length of each of the stripe patterns occurring at intervals on the order of several millimeters, which are confirmed when an optional region having a size of 100 mm×100 mm is visually confirmed, is 50 mm or less. The maximum length of the stripe pattern is preferably 20 mm or less. Further, it is more preferable that no stripe pattern is observed.

In the press-formed article according to the present embodiment, since the occurrence of ghost lines is suppressed, Wz, which is the sum of the maximum peak height Zp and the maximum valley height Zv of the waviness curve, is 0.60 μm or less.

Further, by manufacturing a press-formed article by using the steel sheet in which 3σ/μ is preferably controlled, it is possible to obtain a press-formed article having more excellent external appearance quality. That is, it is possible to obtain a press-formed article in which Wz, which is the sum of the maximum peak height Zp and the maximum valley height Zv of the waviness curve, is 0.40 μm or less.

Wz is obtained by obtaining the waviness curve of the surface of a press-formed article, obtaining the maximum peak height Zp and the maximum valley height Zv, and calculating the sum of these heights, in accordance with JIS B 0601:2013.

Next, a method for manufacturing the steel sheet according to the present embodiment will be described.

In the steel sheet according to the present embodiment, the effect thereof can be obtained as long as it has the above characteristics, regardless of a manufacturing method. Further, it may be a steel strip instead of the steel sheet. However, the steel sheet in which the arithmetic mean waviness Wa is preferably controlled can be stably manufactured by using steel having the chemical composition described above and controlling, for example, the following conditions (I) to (IV) in a complex and inseparable manner. Further, in order to preferably control 3σ/μ, it is preferable to control a condition (V) in addition to the following conditions (I) to (IV). Further, in order to preferably control the thickness of the decarburized layer, it is preferable to further control a condition (VI) in addition to the following conditions (I) to (IV). The conditions (V) and (VI) are optional conditions.

Hereinafter, each condition will be described.

(I) A coiling temperature is set to 550° C. or higher.

(II) A pickling time is set to 50 seconds or longer.

(III) Arithmetic average roughness Ra of a surface of a rolling roll in the final pass of cold rolling is set to be in a range of 0.2 to 0.7 μm.

(IV) A rolling reduction of temper rolling is set to be in a range of 0.3 to 0.7%, and arithmetic average roughness Ra of the rolling roll is set to be in a range of 1.5 to 3.5 μm.

(V) A slab is heated to a temperature range of 1200° C. or higher and held in the temperature range for 5 hours or longer.

(VI) Annealing is performed in which a dew point (average dew point in an annealing furnace) is set to −20° C. or higher and a stay time of the steel sheet in a temperature range of 700° C. or higher is set to be in a range of 50 to 400 seconds.

(I) Coiling temperature: 550° C. or higher

By setting the coiling temperature after the hot rolling to a high temperature range of 550° C. or higher, scales easily occur on the surface of the steel sheet. As a result, irregularities easily occur on the surface of the steel sheet after pickling. The coiling temperature is more preferably 600° C. or higher, and even more preferably 650° C. or higher.

(II) Pickling time: 50 seconds or longer

By setting the pickling time to 50 seconds or longer in the pickling after the coiling and before the cold rolling, irregularities easily occur on the surface of the steel sheet. It is more preferable that the pickling time is set to 70 seconds or longer.

(III) Arithmetic average roughness Ra of a rolling roll in the final pass of cold rolling: 0.2 to 0.7 μm By setting the arithmetic average roughness Ra of the surface of the rolling roll in the final pass in the cold rolling after the pickling to be in a range of 0.2 to 0.7 μm, it is possible to form moderate irregularities on the surface of the steel sheet during the cold rolling. It is more preferable that the arithmetic average roughness Ra of the rolling roll is set to 0.3 μm or more.

In an ordinary rolling roll, since it does not have the arithmetic average roughness Ra described above, the steel sheet according to the present embodiment cannot be manufactured. In order to manufacture the steel sheet according to the present embodiment, it is desirable to use a special rolling roll in the final pass of the cold rolling.

(IV) Rolling reduction of temper rolling: 0.3 to 0.7%, and arithmetic average roughness Ra of the rolling roll: 1.5 to 3.5 μm By setting the rolling reduction to be in a range of 0.3 to 0.7% and setting the arithmetic average roughness Ra of the surface of the rolling roll to be in a range of 1.5 to 3.5 μm in the temper rolling after the annealing (after plating for a plated material), irregularities can be formed on the surface of the steel sheet. It is more preferable that the rolling reduction during the temper rolling is 0.5% or more and that the arithmetic average roughness Ra of the surface of the rolling roll is 2.3 μm or more.

(V) Heating temperature and holding time of a slab: 5 hours or longer in a temperature range of 1200° C. or higher The condition (V) is an optional condition. By heating the slab in a temperature range of 1200° C. or higher for 5 hours or longer, it is possible to preferably control 3σ/μ in the region from a position separated by ⅛ of the sheet thickness in the sheet thickness direction from the surface of the steel sheet to a position separated by ⅜ of the sheet thickness in the sheet thickness direction from the surface (the region from ⅛ depth from the surface of the steel sheet to ⅜ depth from the surface of the steel sheet). As a result, the occurrence of Mn segregation in the steel sheet can be further reduced, and a press-formed article having more excellent external appearance quality can be obtained.

(VI) Dew point: −20° C. or higher, and stay time of the steel sheet in a temperature range of 700° C. or higher: 50 to 400 seconds.

The condition (VI) is an optional condition. In the present embodiment, annealing may be performed on a cold-rolled steel sheet obtained by the method described above. By setting the dew point during the annealing (average dew point in the annealing furnace) to −20° C. or higher and setting the stay time of the steel sheet in the temperature range of 700° C. or higher to be in a range of 50 to 400 seconds, it is possible to stably decarburize the surface of the steel sheet. In this way, a decarburized layer having a thickness of 30 μm or more can be formed on the surface of the steel sheet. Although an upper limit of the dew point does not need to be specified, it may be set to about 10° C.

Conditions other than the conditions described above are not particularly limited. However, it is preferable to satisfy, for example, the following conditions.

After a slab is heated to a temperature range of 1100° C. or higher, a steel piece is hot-rolled. After the hot rolling, coiling is performed, and then pickling is performed. After the pickling, cold rolling is performed. It is preferable that a cumulative rolling reduction in the cold rolling is set to be in a range of 30 to 90%. After the cold rolling, annealing is performed. Thereafter, the plating layer described above is formed as necessary. Further, thereafter, it is preferable to perform temper rolling.

Next, a method for manufacturing the press-formed article according to the present embodiment will be described. The press forming method is not particularly limited. For example, a vehicle panel system component such as a door outer can be formed by pressing the steel sheet with a blank holder and a die, applying strain to the steel sheet by pressing it with a punch, and stretching the steel sheet. Such forming is called draw forming or stretch forming.

EXAMPLES

Next, examples of the present invention will be described. However, conditions in the examples are examples of conditions that are adopted to confirm the feasibility and effect of the present invention. The present invention is not limited to these condition examples. The present invention can adopt various conditions as long as the object of the present invention is achieved without departing from the gist of the present invention.

Steel having the chemical composition shown in Table 1 was melted, and a slab with a thickness in a range of 240 to 300 mm was manufactured by continuous casting. A cold-rolled steel sheet and a plated steel sheet were manufactured under the conditions (I) to (V), which will be described later, by using the obtained slabs. In Table 2, in a case where the conditions were satisfied, "OK" was written in the condition column, and in a case where the conditions were not satisfied, "NG" was written in the condition column. Further, the sheet thickness of each of the obtained steel sheet and plated steel sheet was in a range of 0.2 to 2.0 mm.

Further, annealing was performed after cold rolling.

Manufacturing conditions other than the conditions (I) to (VI) were as follows. After a slab was heated to a temperature range of 1100° C. or higher, it was hot-rolled. After the hot rolling, coiling was performed, and then pickling was performed. After the pickling, cold rolling was performed with a cumulative rolling reduction in a range of 30 to 90%. After the cold rolling, annealing was performed to form a hot-dip galvannealed layer (GA), a hot-dip galvanized layer (GI), and an electroplating layer (EG), as necessary. Thereafter, temper rolling was performed.

The conditions (I) to (VI) in the table are as follows.

(I) A coiling temperature is set to 550° C. or higher.

(II) A pickling time is set to 50 seconds or longer.

(III) Arithmetic average roughness Ra of a surface of a rolling roll in the final pass of cold rolling is set to be in a range of 0.2 to 0.7 μm.

(IV) A rolling reduction of temper rolling is set to be in a range of 0.3 to 0.7%, and arithmetic average roughness Ra of the rolling roll is set to be in a range of 1.5 to 3.5 μm.

(V) A slab is heated to a temperature range of 1200° C. or higher and held in the temperature range for 5 hours or longer.

(VI) Annealing is performed in which a dew point (average dew point in an annealing furnace) is set to −20° C. or higher and a stay time of the steel sheet in a temperature range of 700° C. or higher is set to be in a range of 50 to 400 seconds.

Next, substantially semi-cylindrical simulated components (press-formed articles) simulating a door outer were manufactured by press forming by using the manufactured steel sheet and plated steel sheet. When press-forming the simulated component, a material (steel sheet or plated steel sheet) was actively put into a die, and at any position on the surface of the simulated component, the ratio of strain in a direction perpendicular to any direction along the surface of the simulated component to strain in the direction (any direction) was set to about 1. That is, the press forming was performed such that the anisotropy of strain did not occur at any position on the surface of the simulated component.

With respect to the obtained steel sheets and plated steel sheets, the arithmetic mean waviness Wa, the average value μ and standard deviation σ of the Mn concentration, the tensile strength, and the thickness of the decarburized layer were obtained by the methods described above.

In a case where the obtained tensile strength was 500 MPa or more, it was determined to be high strength and acceptable. On the other hand, in a case where the obtained tensile strength was less than 500 MPa, it was determined to be unacceptable because the strength was inferior.

Further, the external appearance quality of the simulated component was evaluated by the following method, The external appearance quality was evaluated by the degree of ghost lines occurring on the surface of the simulated component after forming. The surface after press forming was ground with a grindstone, striped patterns at intervals on the order of several millimeters, which occurred on the surface, were determined to be ghost lines, and scores of 1 to 5 were given according to the degree of the occurrence of the stripe patterns. Any region having a size of 100 mm×100 mm was visually confirmed, and a case where no stripe pattern was confirmed was rated as "1", a case where the maximum length of the stripe pattern was 20 mm or less was rated as "2", a case where the maximum length of the stripe pattern exceeds 20 mm and 50 mm or less was rated as "3", a case where the maximum length of the stripe pattern exceeds 50 mm and 70 mm or less was rated as "4", and a case where the maximum length of the stripe pattern exceeds 70 mm was rated as "5". In a case where the evaluation was "3" or lower, it was determined to be excellent in external appearance quality and acceptable. On the other hand, in a case where the evaluation was "4" or higher, it was determined to be unacceptable because the external appearance quality was inferior.

Further, the external appearance quality was also evaluated more strictly by "Wz, which is the sum of the maximum peak height Zp and the maximum valley height Zv of the waviness curve". The waviness curve of the surface of the press-formed article (simulated component) was obtained in accordance with JIS B 0601:2013 by the same method as that used to obtain the arithmetic mean waviness Wa. From this waviness curve, the maximum peak height Zp and the maximum valley height Zv were obtained, and Wz was obtained by calculating the sum of these heights. In a case where the obtained Wz was 0.40 μm or less, it was determined that the external appearance quality was more excellent.

TABLE 1

| Steel | Chemical composition (mass %) Remainder: Fe and impurities | | | | | | | | | | | | | Remarks |
|---|---|---|---|---|---|---|---|---|---|---|---|---|---|---|
| | C | Mn | Si | P | S | Al | N | O | Cr | Mo | B | Ti | Other | |
| A | 0.052 | 1.88 | 0.015 | 0.018 | 0.0018 | 0.297 | 0.0035 | 0.0009 | | | | | | Present invention steel |
| B | 0.050 | 1.80 | 0.013 | 0.020 | 0.0011 | 0.300 | 0.0038 | 0.0013 | 0.39 | 0.07 | 0.0018 | 0.010 | | Present invention steel |
| C | 0.053 | 1.81 | 0.010 | 0.036 | 0.0026 | 0.036 | 0.0045 | 0.0010 | 0.40 | 0.07 | 0.0020 | 0.012 | | Present invention steel |
| D | 0.059 | 1.50 | 0.013 | 0.020 | 0.0017 | 0.300 | 0.0035 | 0.0019 | 0.36 | 0.07 | 0.0015 | 0.010 | | Present invention steel |
| E | 0.061 | 1.80 | 0.012 | 0.018 | 0.0016 | 0.307 | 0.0039 | 0.0015 | 0.40 | 0.07 | 0.0015 | 0.010 | | Present invention steel |
| F | 0.060 | 1.89 | 0.015 | 0.025 | 0.0020 | 0.034 | 0.0031 | 0.0009 | | 0.07 | 0.0016 | 0.010 | | Present invention steel |
| G | 0.060 | 1.80 | 0.010 | 0.020 | 0.0021 | 0.035 | 0.0044 | 0.0009 | 0.10 | 0.02 | 0.0014 | 0.015 | | Present invention steel |
| H | 0.060 | 2.16 | 0.011 | 0.020 | 0.0013 | 0.303 | 0.0048 | 0.0019 | 0.40 | 0.07 | 0.0021 | 0.010 | | Comparative steel |
| I | 0.072 | 1.80 | 0.012 | 0.022 | 0.0017 | 0.300 | 0.0035 | 0.0015 | 0.42 | 0.07 | | | | Present invention steel |
| J | 0.081 | 1.25 | 0.010 | 0.020 | 0.0014 | 0.296 | 0.0035 | 0.0012 | 0.40 | 0.12 | | | | Present invention steel |
| K | 0.080 | 2.05 | 0.450 | 0.019 | 0.0020 | 0.050 | 0.0036 | 0.0013 | | | | | | Comparative steel |
| L | 0.110 | 1.30 | 0.010 | 0.020 | 0.0028 | 0.030 | 0.0035 | 0.0015 | 0.40 | 0.10 | | | | Comparative steel |
| M | 0.061 | 1.70 | 0.102 | 0.016 | 0.0026 | 0.033 | 0.0030 | 0.0014 | 0.55 | 0.07 | 0.0015 | 0.020 | Nb: 0.005, Sb: 0.005 | Present invention steel |
| N | 0.060 | 1.71 | 0.105 | 0.020 | 0.0033 | 0.030 | 0.0033 | 0.0015 | 0.55 | 0.07 | 0.0018 | 0.015 | V: 0.01, REM: 0.0017 | Present invention steel |
| O | 0.059 | 1.68 | 0.103 | 0.022 | 0.0025 | 0.037 | 0.0037 | 0.0015 | 0.55 | 0.07 | 0.0019 | 0.010 | W: 0.03, Cu: 0.05 | Present invention steel |
| P | 0.060 | 1.70 | 0.010 | 0.024 | 0.0020 | 0.029 | 0.0035 | 0.0015 | 0.55 | 0.07 | 0.0015 | 0.040 | Ni: 0.05, Sn: 0.08 | Present invention steel |
| Q | 0.030 | 1.80 | 0.014 | 0.020 | 0.0020 | 0.301 | 0.0033 | 0.0013 | 0.40 | 0.07 | 0.0015 | 0.013 | | Comparative steel |
| R | 0.052 | 0.90 | 0.009 | 0.021 | 0.0018 | 0.034 | 0.0041 | 0.0009 | 0.40 | 0.08 | 0.0020 | 0.010 | | Comparative steel |
| S | 0.060 | 1.72 | 0.152 | 0.020 | 0.0028 | 0.054 | 0.0042 | 0.0015 | 0.55 | 0.07 | 0.0020 | 0.011 | Zr: 0.001, REM: 0.002 | Present invention steel |
| T | 0.060 | 1.70 | 0.152 | 0.015 | 0.0021 | 0.051 | 0.0038 | 0.0015 | 0.53 | 0.07 | 0.0017 | 0.010 | Mg: 0.0029 | Present invention steel |
| U | 0.062 | 1.73 | 0.153 | 0.020 | 0.0024 | 0.057 | 0.0035 | 0.0015 | 0.55 | 0.07 | 0.0015 | 0.010 | Ca: 0.0016, REM: 0.0014 | Present invention steel |

The underline indicates that the value falls outside the range of the present invention.

TABLE 2

| Steel sheet | | Manufacturing conditions | | | | | | Steel sheet | |
|---|---|---|---|---|---|---|---|---|---|
| | | | | | | | | Decarburized layer thickness | Arithmetic mean waviness Wa |
| No. | Steel | (I) | (II) | (III) | (IV) | (V) | (VI) | (μm) | (μm) |
| 1 | A | OK | OK | OK | OK | NG | NG | 0 | 0.15 |
| 2 | A | OK | OK | OK | OK | OK | NG | 0 | 0.16 |
| 3 | B | OK | OK | OK | OK | NG | NG | 0 | 0.12 |
| 4 | C | OK | OK | OK | OK | NG | NG | 10 | 0.16 |
| 5 | D | OK | OK | OK | OK | NG | OK | 35 | 0.19 |
| 6 | E | OK | OK | OK | OK | NG | NG | 0 | 0.13 |
| 7 | E | OK | OK | OK | OK | OK | NG | 0 | 0.14 |
| 8 | E | NG | OK | OK | OK | NG | NG | 15 | 0.07 |
| 9 | E | OK | NG | OK | OK | NG | NG | 0 | 0.09 |
| 10 | E | OK | OK | NG | OK | NG | NG | 0 | 0.08 |
| 11 | E | OK | OK | OK | NG | NG | NG | 0 | 0.31 |
| 12 | E | NG | NG | OK | OK | NG | OK | 22 | 0.08 |
| 13 | E | OK | OK | NG | NG | NG | NG | 0 | 0.33 |
| 14 | F | OK | OK | OK | OK | NG | NG | 0 | 0.16 |
| 15 | F | OK | OK | OK | OK | OK | NG | 0 | 0.17 |
| 16 | G | OK | OK | OK | OK | NG | OK | 32 | 0.13 |
| 17 | H | OK | OK | OK | OK | NG | NG | 0 | 0.15 |
| 18 | T | OK | OK | OK | OK | NG | NG | 12 | 0.17 |

TABLE 2-continued

| | | | | | | | | | |
|---|---|---|---|---|---|---|---|---|---|
| 19 | I | OK | OK | OK | OK | OK | NG | 15 | 0.16 |
| 20 | J | OK | OK | OK | OK | NG | NG | 0 | 0.19 |
| 21 | J | OK | OK | OK | OK | OK | NG | 0 | 0.14 |
| 22 | K | OK | OK | OK | OK | NG | OK | 35 | 0.20 |
| 23 | L | OK | OK | OK | OK | NG | NG | 18 | 0.18 |
| 24 | M | OK | OK | OK | OK | NG | NG | 0 | 0.15 |
| 25 | M | OK | NG | NG | OK | NG | NG | 0 | 0.07 |
| 26 | N | OK | OK | OK | OK | NG | OK | 25 | 0.19 |
| 27 | O | OK | OK | OK | OK | NG | NG | 0 | 0.15 |
| 28 | P | OK | OK | OK | OK | NG | NG | 0 | 0.11 |
| 29 | Q | OK | OK | OK | OK | NG | NG | 0 | 0.15 |
| 30 | R | OK | OK | OK | OK | NG | NG | 0 | 0.12 |
| 31 | S | OK | OK | OK | OK | NG | OK | 52 | 0.22 |
| 32 | T | OK | OK | OK | OK | NG | NG | 0 | 0.12 |
| 33 | U | OK | OK | OK | OK | OK | NG | 0 | 0.17 |

| Steel | Steel sheet | | | Press-formed article | | |
|---|---|---|---|---|---|---|
| sheet No. | (3σ/μ) × 100 | Plating type | Tensile strength(MPa) | External appearance evaluation | Wz (μm) | Remarks |
| 1 | 8.7 | Without | 543 | 3 | 0.41 | Present invention example |
| 2 | 5.8 | Without | 536 | 2 | 0.34 | Present invention example |
| 3 | 8.6 | GA | 603 | 3 | 0.52 | Present invention example |
| 4 | 7.8 | GA | 595 | 3 | 0.52 | Present invention example |
| 5 | 7.1 | GA | 575 | 2 | 0.53 | Present invention example |
| 6 | 7.8 | GA | 618 | 3 | 0.51 | Present invention example |
| 7 | 6.0 | GA | 612 | 2 | 0.37 | Present invention example |
| 8 | 8.1 | GA | 615 | 5 | 0.51 | Comparative example |
| 9 | 8.3 | GA | 614 | 4 | 0.53 | Comparative example |
| 10 | 7.9 | GA | 618 | 5 | 0.50 | Comparative example |
| 11 | 8.0 | GA | 616 | E0xternal appearance before forming is inferior | 0.78 | Comparative example |
| 12 | 8.2 | GA | 620 | 5 | 0.54 | Comparative example |
| 13 | 8.0 | GA | 608 | External appearance before forming is inferior | 0.81 | Comparative example |
| 14 | 10.1 | GA | 590 | 3 | 0.55 | Present invention example |
| 15 | 6.3 | GA | 581 | 3 | 0.37 | Present invention example |
| 16 | 8.1 | GA | 595 | 2 | 0.52 | Present invention example |
| 17 | 12.5 | GA | 623 | 5 | 0.63 | Comparative example |
| 18 | 8.9 | GA | 645 | 3 | 0.53 | Present invention example |
| 19 | 6.4 | GA | 611 | 2 | 0.38 | Present invention example |
| 20 | 10.3 | GA | 645 | 3 | 0.54 | Present invention example |
| 21 | 6.1 | EG | 622 | 2 | 0.38 | Present invention example |
| 22 | 10.4 | GA | 666 | 5 | 0.66 | Comparative example |
| 23 | 11.4 | GA | 618 | 5 | 0.68 | Comparative example |
| 24 | 7.9 | GA | 621 | 3 | 0.53 | Present invention example |
| 25 | 8.2 | GA | 615 | 4 | 0.49 | Comparative example |
| 26 | 7.5 | GA | 673 | 2 | 0.52 | Present invention example |
| 27 | 7.4 | GI | 635 | 3 | 0.53 | Present invention example |
| 28 | 8.0 | GA | 621 | 3 | 0.54 | Present invention example |
| 29 | 7.9 | GA | 483 | 3 | 0.42 | Comparative example |
| 30 | 7.8 | GA | 465 | 3 | 0.43 | Comparative example |

TABLE 2-continued

| | | | | | | |
|---|---|---|---|---|---|---|
| 31 | 7.2 | GA | 587 | 2 | 0.52 | Present invention example |
| 32 | 7.8 | GA | 630 | 3 | 0.51 | Present invention example |
| 33 | 6.3 | Without | 603 | 3 | 0.38 | Present invention example |

The underline indicates that the value falls outside the range of the present invention and that the characteristic is not preferable.

From Table 2, it can be seen that the press-formed articles according to the present invention examples have high strength and excellent external appearance quality. Further, it can be seen that the steel sheets according to the present invention examples can manufacture press-formed articles having high strength and excellent external appearance quality. Furthermore, it can be seen that the present invention examples in which $3\sigma/\mu$ was 7.0 or less have excellent external appearance quality after press forming.

On the other hand, it can be seen that the press-formed articles according to the comparative examples are inferior in strength or have deteriorated external appearance quality. Further, it can be seen that the steel sheets according to the comparative examples cannot manufacture press-formed articles having high strength and excellent external appearance quality.

INDUSTRIAL APPLICABILITY

According to the above aspects of the present invention, it is possible to provide a press-formed article having high strength and excellent external appearance quality, and a steel sheet which can manufacture of the press-formed article.

What is claimed is:

1. A steel sheet consisting of, as a chemical composition, by mass %:

C: 0.040% to 0.100%;
Mn: 1.00% to 2.00%;
Si: 0.005% to 1.500%;
P: 0.100% or less;
S: 0.0200% or less;
Al: 0.005% to 0.700%;
N: 0.0150% or less;
O: 0.0100% or less;
Cr: 0% to 0.80%;
Mo: 0% to 0.16%;
B: 0% to 0.0100%;
Ti: 0% to 0.100%;
Nb: 0% to 0.060%;
V: 0% to 0.50%;
Ni: 0% to 1.00%;
Cu: 0% to 1.00%;
W: 0% to 1.00%;
Sn: 0% to 1.00%;
Sb: 0% to 0.200%;
Ca: 0% to 0.0100%;
Mg: 0% to 0.0100%;
Zr: 0% to 0.0100%;
REM: 0% to 0.0100%; and
a remainder: Fe and impurities,
wherein an arithmetic mean waviness Wa is in a range of 0.10 to 0.30 μm.

2. A steel sheet consisting of, as a chemical composition, by mass %;

C: 0.040% to 0.100%;
Mn: 1.00% to 2.00%;
Si: 0.005% to 1.500%;
P: 0.100% or less;
S: 0.0200% or less;
Al: 0.005% to 0.700%;
N: 0.0150% or less;
O: 0.0100% or less;
one or more of:
Cr: 0.01% to 0.80%;
Mo: 0.01% to 0.16%;
B: 0.0001% to 0.0100%;
Ti: 0.001% to 0.100%;
Nb: 0.001% to 0.060%;
V: 0.01% to 0.50%;
Ni: 0.01% to 1.00%;
Cu: 0.01% to 1.00%;
W: 0.01% to 1.00%;
Sn: 0.01% to 1.00%;
Sb: 0.001% to 0.200%;
Ca: 0.0001% to 0.0100%;
Mg: 0.0001% to 0.0100%;
Zr: 0.0001% to 0.0100%; and
REM: 0.0001% to 0.0100%; and
a remainder: Fe and impurities,
wherein an arithmetic mean waviness Wa is in a range of 0.10 to 0.30 μm.

3. The steel sheet according to claim 1, wherein Mn concentrations are measured every 1 μm in a sheet thickness direction from a position separated by ⅛ of a sheet thickness in the sheet thickness direction from a surface of the steel sheet to a position separated by ⅜ of the sheet thickness in the sheet thickness direction from the surface of the steel sheet, wherein the Mn concentrations are measured at 600 points in each 1 μm pitch in a rolling direction, perpendicular to the sheet thickness direction, an average value of all measured Mn concentrations is defined as μ and a standard deviation of all measured Mn concentrations is defined as σ, and $(3\sigma/\mu)\times100\leq7.0$ is satisfied.

4. The steel sheet according to claim 1, wherein a surface of the steel sheet has a decarburized layer having a thickness of 20 μm or more.

5. The steel sheet according to claim 1, wherein at least one surface of the steel sheet has a plating layer.

6. A press-formed article that is obtained by press-forming the steel sheet according to claim 1.

7. A steel sheet comprising, as a chemical composition, by mass %:

C: 0.040% to 0.100%;
Mn: 1.00% to 2.00%;
Si: 0.005% to 1.500%;
P: 0.100% or less;
S: 0.0200% or less;
Al: 0.005% to 0.700%;
N: 0.0150% or less;
O: 0.0100% or less;
Cr: 0% to 0.80%;
Mo: 0% to 0.16%;
B: 0% to 0.0100%;
Ti: 0% to 0.100%;
Nb: 0% to 0.060%;
V: 0% to 0.50%;

Ni: 0% to 1.00%;
Cu: 0% to 1.00%;
W: 0% to 1.00%;
Sn: 0% to 1.00%;
Sb: 0% to 0.200%;
Ca: 0% to 0.0100%;
Mg: 0% to 0.0100%;
Zr: 0% to 0.0100%;
REM: 0% to 0.0100%; and
a remainder: Fe and impurities,
wherein an arithmetic mean waviness Wa is in a range of 0.10 to 0.30 μm.

* * * * *